US008191719B2

(12) United States Patent
van Ooyen et al.

(10) Patent No.: US 8,191,719 B2
(45) Date of Patent: Jun. 5, 2012

(54) RACK ARRANGEMENT FOR KIOSK DISPENSER

(75) Inventors: Wes van Ooyen, Burlington (CA); Todd Willick, Mississauga (CA); Derek Bessette, Milton (CA); Richard Panetta, Milton (CA)

(73) Assignee: PCAS Patient Care Automation Services Inc., Oakville (CA)

( * ) Notice: Subject to any disclaimer, the term of this patent is extended or adjusted under 35 U.S.C. 154(b) by 307 days.

(21) Appl. No.: 12/541,307

(22) Filed: Aug. 14, 2009

(65) Prior Publication Data

US 2011/0036856 A1 Feb. 17, 2011

(51) Int. Cl.
*A47F 5/08* (2006.01)

(52) U.S. Cl. ..... 211/87.01; 211/175

(58) Field of Classification Search ..... 211/103, 211/59.2, 86.01, 87.01, 94.01, 193, 184, 211/106.01, 90.01–90.04; 312/245, 246; 108/108, 152, 193, 147.16
See application file for complete search history.

(56) References Cited

U.S. PATENT DOCUMENTS 3,872,802 A * 3/1975 Scheerhorn et al. ..... 108/61
4,046,083 A * 9/1977 Murdoch et al. ..... 108/107
4,634,010 A * 1/1987 Otema ..... 211/96
5,427,255 A * 6/1995 Nook ..... 211/187
5,485,932 A * 1/1996 Romm et al. ..... 211/87.01
5,566,844 A * 10/1996 Bernardin ..... 211/189
6,401,941 B1 * 6/2002 Maumus ..... 211/59.1
6,471,080 B1 * 10/2002 Hoffmann ..... 211/126.1
6,520,355 B1 2/2003 Pritchard et al.
6,659,295 B1 * 12/2003 De Land et al. ..... 211/187
6,726,034 B2 * 4/2004 Holbrook et al. ..... 211/87.01
2004/0108287 A1 * 6/2004 Winig et al. ..... 211/90.01
2005/0230338 A1 10/2005 Farinola et al.
2008/0237159 A1 * 10/2008 Bray et al. ..... 211/59.2
2010/0065523 A1 * 3/2010 Northrup et al. ..... 211/90.02

* cited by examiner

*Primary Examiner* — Jennifer E. Novosad

(74) *Attorney, Agent, or Firm* — Bradley K. DeSandro; Desandro Law Group PLLC

(57) ABSTRACT

A rack assembly of storage bins has a back wall, series of vertical slots in the back wall, partition members having tongues for fixing the partition member to the back wall. Extending between the partition members are bin floors, the edges of the floor members located in slots in the partition members. The spacing of the slots in the back wall and of the slots in the partition members is selected to permit a range of spacings of horizontally adjacent partition members and a range of spacings of vertically adjacent floor members. By suitable selection of the spacings, a large variety of bin sizes can be obtained.

19 Claims, 10 Drawing Sheets

RACK ARRANGEMENT FOR KIOSK DISPENSER

FIELD OF THE INVENTION

This invention relates to a rack arrangement for a dispensing system and has particular application to a rack arrangement for a medicament kiosk dispenser.

DESCRIPTION OF RELATED ART

In this specification, the term "medicament" encompasses drugs and any and all other materials dispensed subject to presentation of a prescription. The traditional means of dispensing prescribed medicaments involves a doctor meeting with a patient and prescribing a medicament based on a particular diagnosis, and then hand writing and signing a prescription for the patient to carry to a pharmacist at a pharmacy location for fulfillment. In recent years, two major advancements have occurred in the field of medicament dispensing. The first is the advent of electronic prescription capturing methods, systems and apparatus, which improve the overall accuracy and patient record-keeping associated with prescribing drugs. The second is the advent of automated apparatus, typically configured as kiosks, from which medicaments can be automatically dispensed, the kiosks being located for convenient patient access, such as at a doctor's premises, a hospital or mall, and being networked with a system server for inventory control and management. In this regard, reference may be made to applicant's copending PCT application serial no. PCT/CA2007/001220 related to a method, system and apparatus for dispensing drugs.

More specifically, the PCT application describes a networked system having a server, a database of patient information linked to the server, a first client having input means linked to the server and operable to generate a script for a medicament prescribed to a user, a second client comprising an automated apparatus for dispensing medicaments (referred to in said PCT application as a robotic prescription dispensary) operable to recognize a human and/or machine readable description in the script, and to provide validating cross-referencing between the description and patient information as a prelude to dispensing a drug to the user on the basis of the input script. A doctor in a clinic can be a third client having input means linked to the server to input appropriate prescription information, or accept certain prescription information from the database as being applicable in the particular case for a particular patient. Further, the doctor's client device can be operable to display patient information, e.g., drug history, insurance coverage, etc., and a printer module can print the script as a paper print-out.

The server and database enable storing, compiling and retrieval of patient data including name, address, and diagnostic and drug history. Access to the database can be provided to both the doctor and the automated apparatus for dispensing medicaments via the server, via a secure connection, or via a link between the system and a clinic's existing clinic management system or patient database.

The described apparatus also includes a user interface, a teleconferencing or video-conferencing means enabling communication between the user and a human validation agent, and a scanning means for capturing an image of the script so that it, if needed, it can be viewed by a human validation agent, such as a licensed pharmacist communicating in the system and with the apparatus from a remote location to the apparatus, to approve a prescription. The user interface of the dispensary apparatus provides detailed and clear instructions to guide the user.

An authentication means confirms the identity of the patient, for example, by prompting for a personal identification number or by biometric means or by associating certain questions to answers provided by the patient that identify the patient to the apparatus, and cross-referencing this information with the patient information stored on the networked database. Once the patient is recognized, the dispensary apparatus prompts the user for a script and the apparatus processes the user-input script either by the above-mentioned human validation agent or by processing the machine readable description (which may be a bar code). This information can be verified with the server and the database. The apparatus may also interface with the server to adjudicate insurance claims and to determine amounts payable by patients. The patient either accepts or rejects the transaction. If the transaction is accepted, the apparatus interfaces with the server to transact a payment, for example, by prompting the patient for credit card information. Prescription labels and receipts are printed. The apparatus confirms that the drug is correct and delivers it to a dispensing area for retrieval by the user while retaining the script in a lock box, and verifying that the purchased drug product has been retrieved. Further, the apparatus may print and/or provide to the user educational materials relevant to the medicaments that have been dispensed. The automated dispensing apparatus for is of significant value in enabling a patient to obtain prescribed medicaments without having to attend a pharmacy or drug store.

In known medicament dispensary kiosks for dispensing bottles or packages of drugs or other medicament packages, the packages are typically stacked in a row column rack of bins. To pick a package from a bin, a pick head is driven in X and Y directions to a desired XY position corresponding to the selected bin. A platform forming part of the pick head is then moved in the Z direction to pick the package from the selected bin.

Medicament packages may have a range of shapes and sizes depending on the size of the medicament to be dispensed and depending also on the particular packaging practices of the medicament supplier. Because space is at a premium in such a kiosk, ideally a bin size for a particular medicament package closely matches the size of package. Because the distribution of package sizes will normally vary from kiosk to kiosk, the bin racks would ideally be tailored for the particular kiosks in which they are to be installed.

SUMMARY OF THE INVENTION

According to one aspect of the invention, there is provided a rack assembly having a support and first and second pluralities of partition members, the partition members of one of the pluralities of partition members demountably mounted to the support, and the partition members of the other plurality of partition members demountably mounted to respective ones of the partition members of the one plurality of partition members, first mounting fixtures on the support and second mounting fixtures on the partition members of said one plurality of partition members, respective pairings of the first and second mounting fixtures interengageable to demountably mount the partition members of said one plurality of partition members to the support, and third mounting fixtures on the partition members of the one plurality of partition members and fourth mounting fixtures on the partition members of the other plurality of partition members, respective pairings of the third and fourth mounting fixtures interengageable to demountably mount partition members of said other plurality of partition members to partition members of said one plurality of partition members.

Preferably, the partition members of said one plurality of partition members extend generally vertically, and the partition members of the other plurality of partition members extend generally horizontally. The rack assembly can have a plurality of bins, each bin having opposed side walls and opposed upper and lower floor members, the side walls each comprising at least a part of respective partition members of said one plurality of partition members, the floor members each comprising a respective partition member of said other plurality of partition members, each bin having side walls in common with immediately laterally adjacent bins and floor members in common with immediately vertically adjacent bins.

To permit a high degree of adjustment in bin width, the first mounting fixtures can be positioned as a plurality of vertically extending series, each series of first mounting fixtures horizontally spaced from an adjacent series of first mounting fixtures by a predetermined distance L, with each floor member having a width n×L, where n is an integer between 1 and N and where N×L is the width of the rack. To permit a high degree of adjustment in bin height, each fourth mounting fixture is vertically spaced from a next vertically adjacent fourth mounting fixture by a predetermined distance H, with each bin side wall having a height m×L, where m is an integer between 1 and M and where M×H is the height of the rack

BRIEF DESCRIPTION OF THE DRAWINGS

For simplicity and clarity of illustration, elements illustrated in the following figures are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF THE INVENTION INCLUDING THE PRESENTLY PREFERRED EMBODIMENTS

Figure 1:
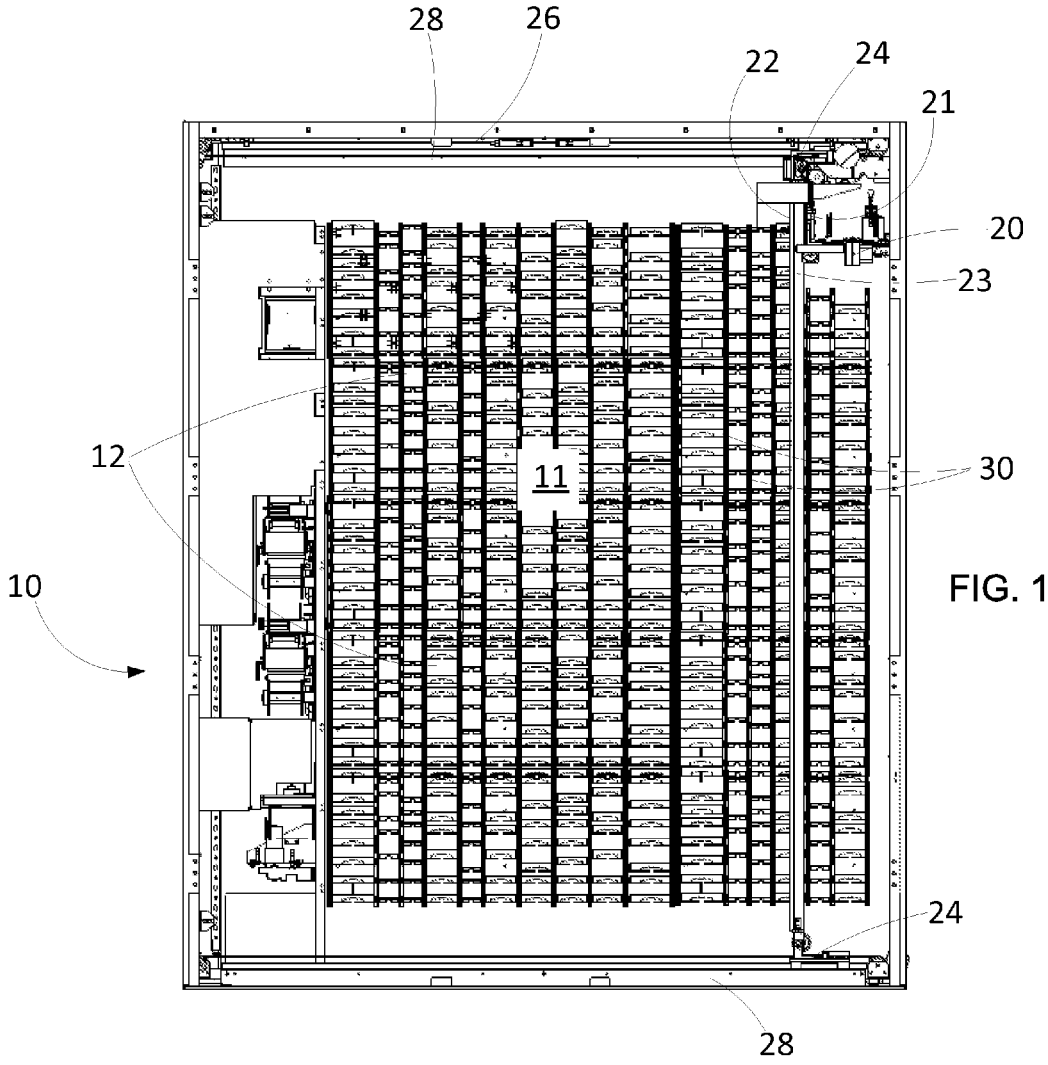
FIG. 1 is a front view of a storage apparatus for a package dispensing kiosk according to one embodiment of the invention.
Figure 2:
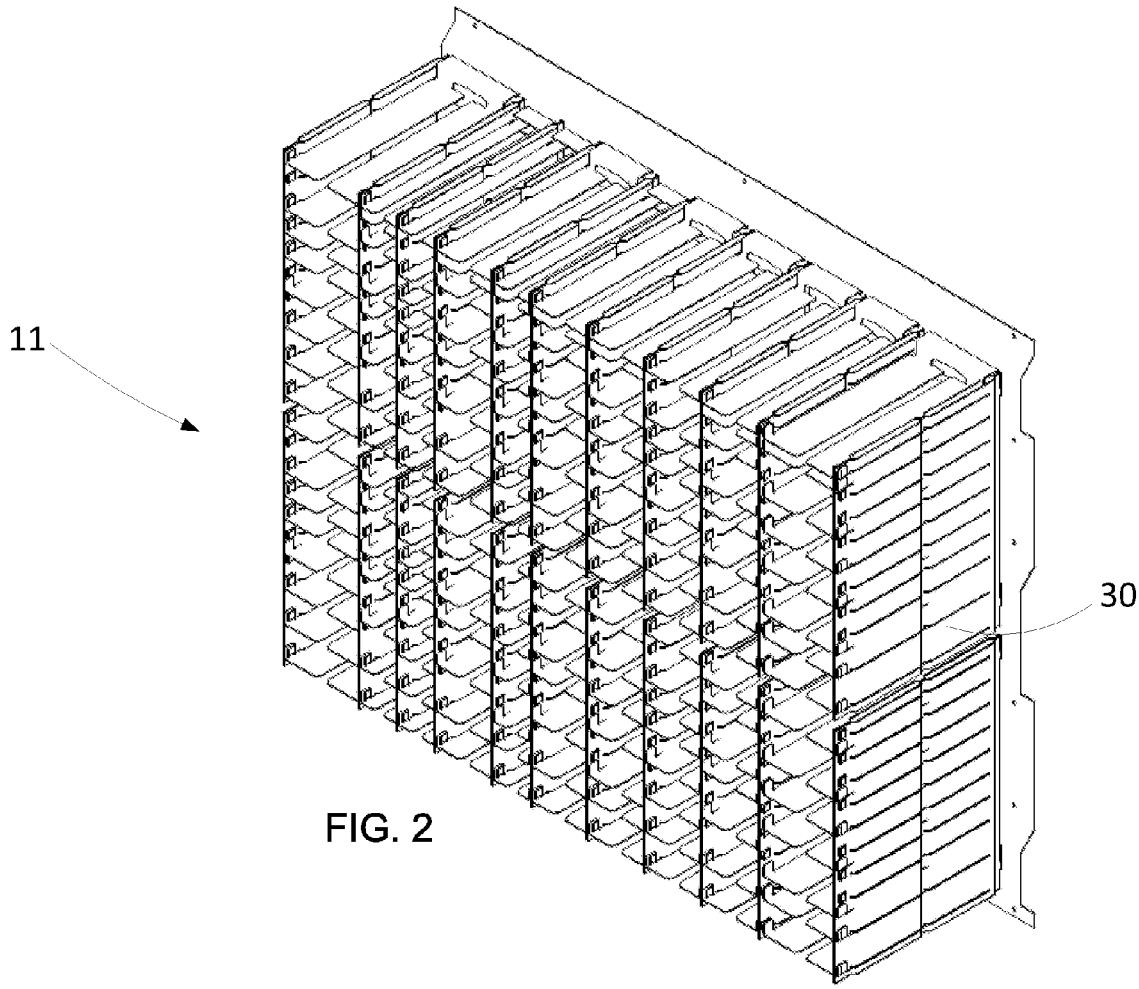
FIG. 2 is a perspective view of a bin rack forming part of the storage apparatus of FIG. 1.

Referring in detail to FIG. 1, there is shown a cabinet 10 for a dispensing kiosk, the cabinet having a rack 11 of storage bins 12 arranged in a row and column array. The bins vary in shape and size to accommodate different sizes of packages to be dispensed. Particularly for the application envisioned for the present invention, the rack of storage bins is formed as a secure back end medicament storage vault. The storage vault is, in use, combined with a front end unit (not shown) which bars unauthorized access to the drug vault but which can be opened to expose the drug vault for servicing. Mounted in the front end unit is an interface unit (not shown) at which a user, can enter data, communicate with a remote expertise or data records through a data or teleconference link, and collect dispensed packages, etc.

As shown in FIG. 1, a pick head 20 is mounted on a vertically reciprocable carriage 21 which is driven by a belt drive 22 along a vertical guide rail 23. The rail 23 is mounted between two linked, horizontally reciprocable carriages 24. The carriages 24 are driven by a belt drive 26 along horizontal rails 28. The carriages 21 and 24 are movable in a plane which extends parallel to a front access side 19 of the bin rack 11. In this way, the pick head 20 can be placed adjacent any selected one of the bins 12 at the front access side 19 of the bin rack. The pick head is used to pick a chosen package from its position in the rack of bins and, if part of a stack or row of packages, from its position within the stack or row, in preparation for dispensing the package at an access bay in the front end interface unit. Optionally, the pick head can also be used to load medicament packages in a bin in a reverse process. Particular pick head mechanisms for use with the illustrated rack of the present invention are described in applicant's copending U.S. patent application Ser. No. 12/503,989.

Figure 3:
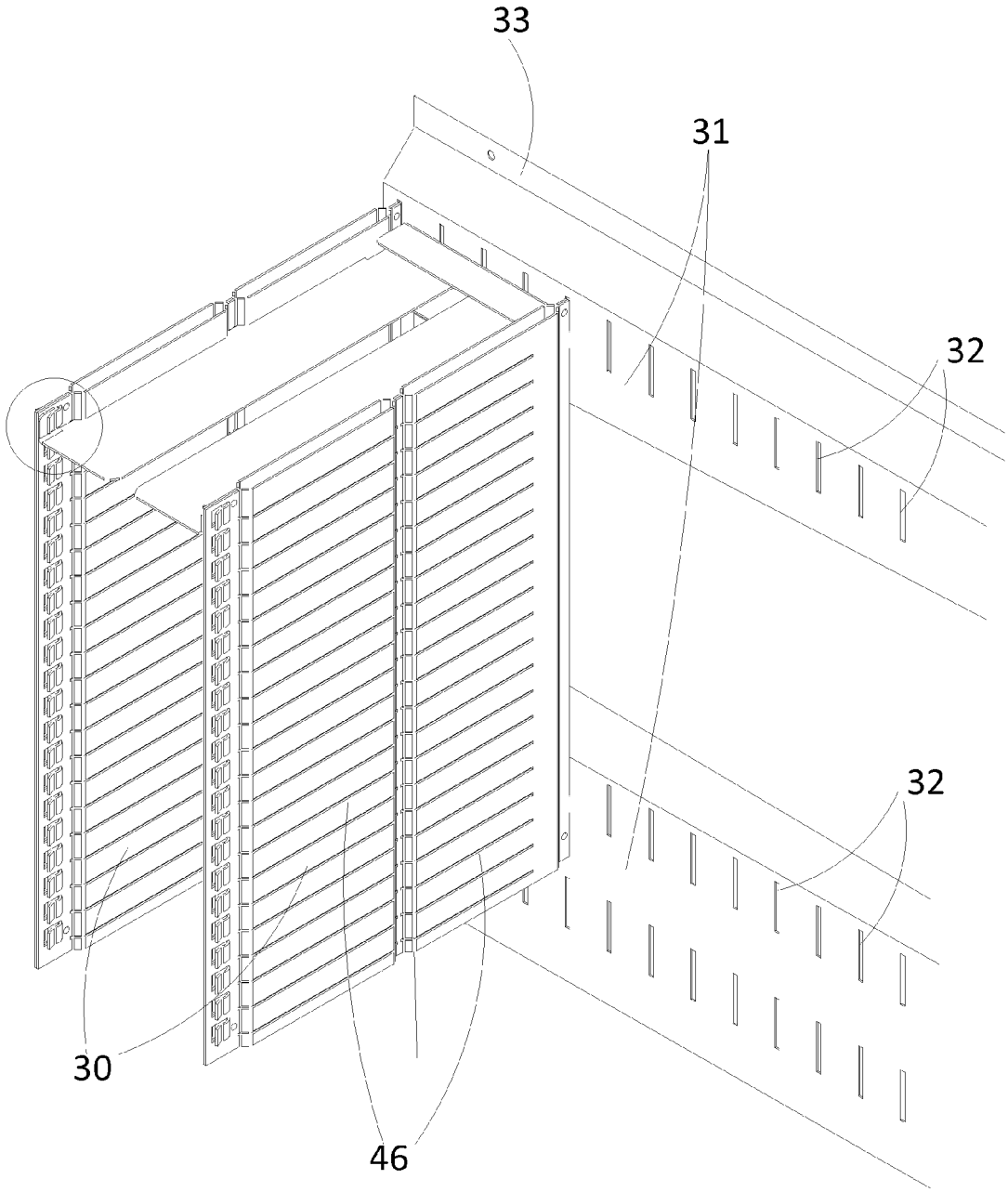
FIG. 3 is a perspective view of part of a back panel forming part of the storage apparatus of FIG. 1.
Figure 4:
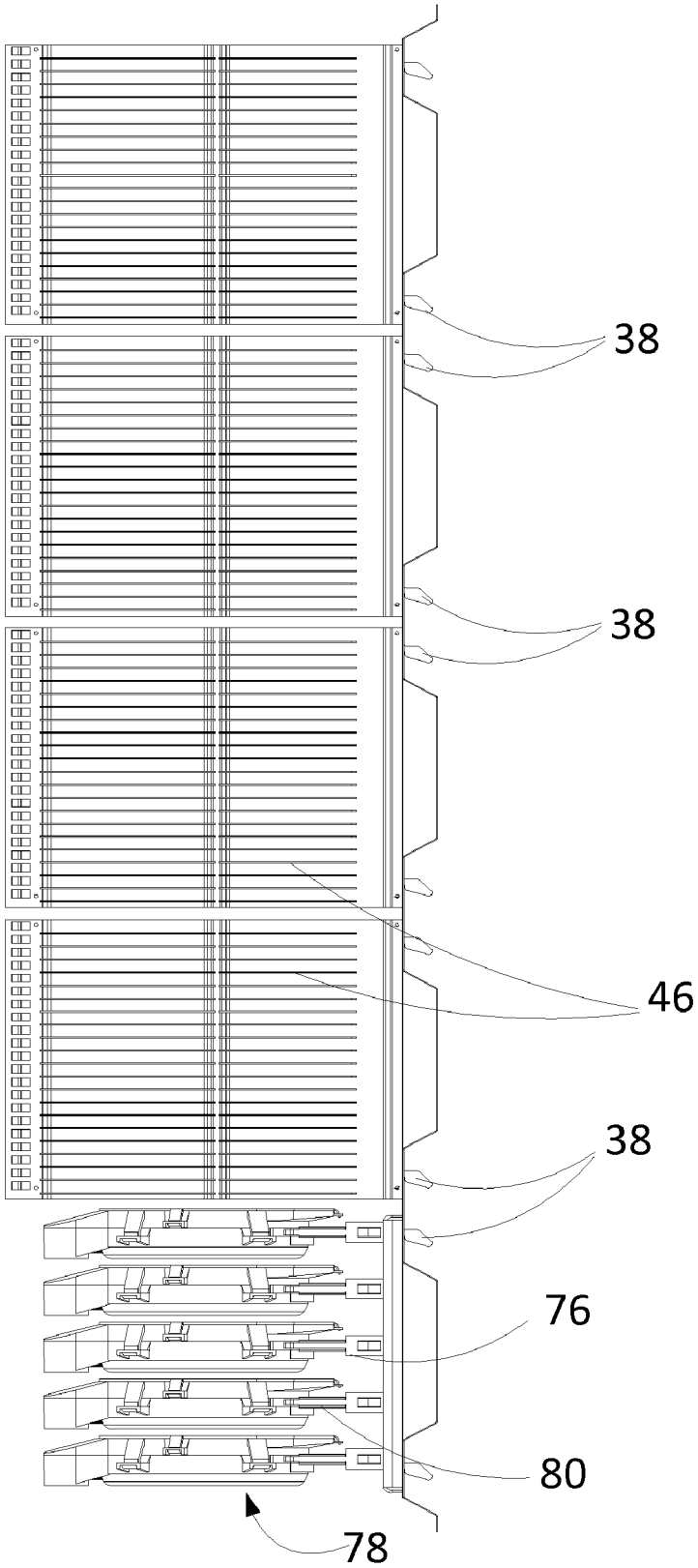
FIG. 4 is a side view of the storage apparatus of FIG. 1.

The rack has a series of vertical partition members 30, two of which are shown in the perspective view of FIG. 3, and four of which are shown in the side view FIG. 4. The partition members 30, in a form assembled as part of the storage apparatus, are shown from the front and to a larger scale in the perspective detail view of FIG. 5. As shown in FIG. 4, extending from the rear of each partition member 30 are tongues 38. The tongues are positioned and dimensioned to enable the partition members 30 to be fitted into vertically extending slots 32 formed in raised portions 31 of a back panel 33. The back panel 33 forms part of a kiosk back wall when the system is assembled. The tongues are shaped so that the weight of each partition member 30 acts to resist any tendency for the partition member to slide out of the slots 32.

Figure 6:
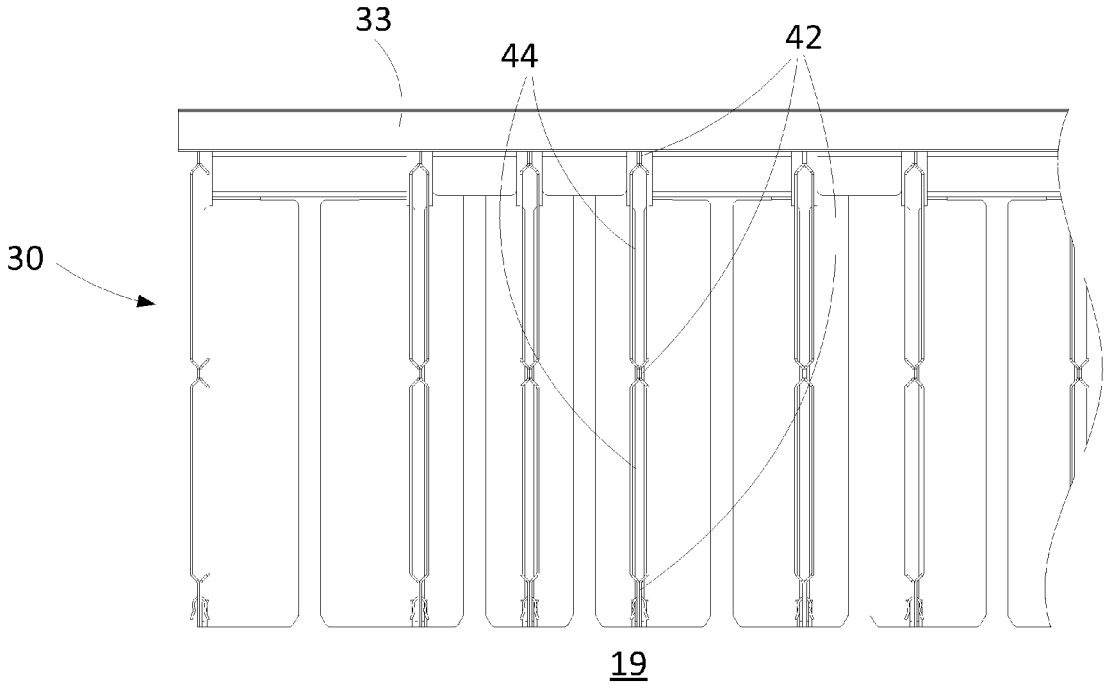
FIG. 6 shows a top view of the detail of FIG. 5.
Figure 7:
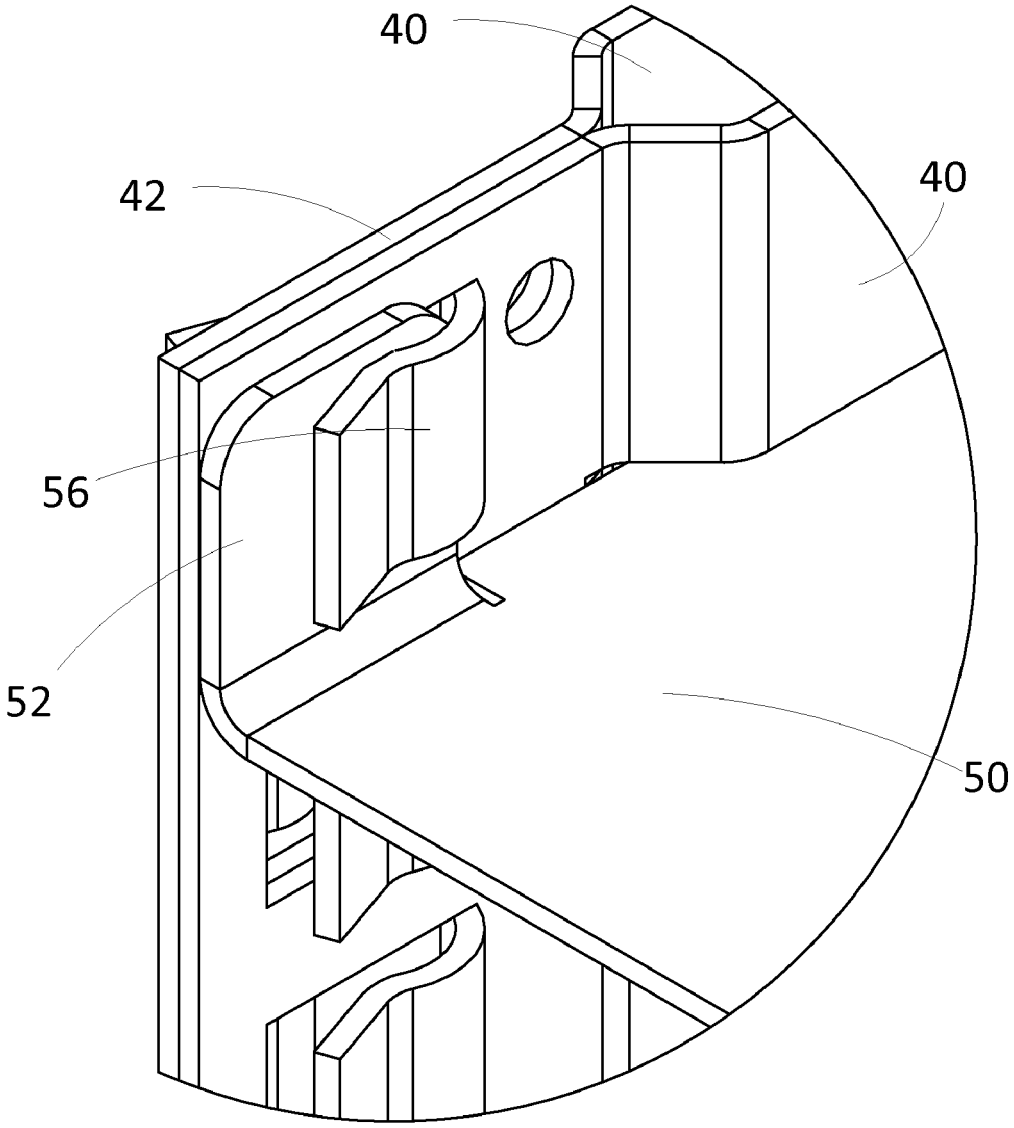
FIG. 7 is a perspective view to a larger scale of the circled detail from the view of FIG. 3.

As shown in FIGS. 6 and 7, each partition member 30 is formed from two parallel plates 40 which are spaced apart except at front, intermediate and back zones 42 where the plates are joined together as by welds or suitable fixing means. This construction provides the partition members 30 with considerable resistance to flexure and to forces that might otherwise tend to distort its shape. Over regions 44, where the plates 40 are spaced from one another, the plates are formed with a series of horizontal slots 46. The slots extend across the full width of each partition member 30 and are dimensioned to permit a horizontally extending partition member configured as a floor member 50 to be slid into the storage apparatus between slots at the same height in opposed faces of adjacent partition members so as to span the partition members.

Figure 5:
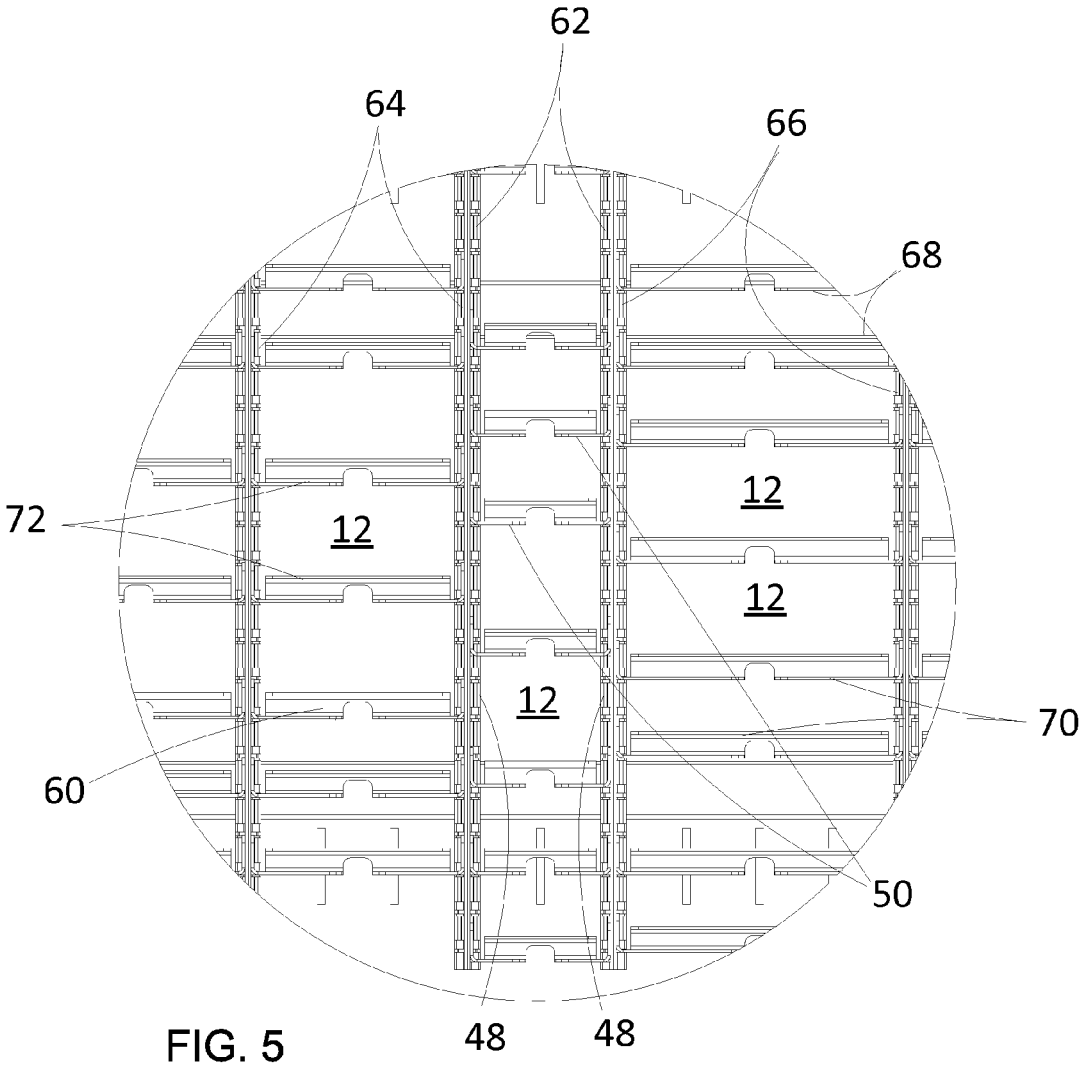
FIG. 5 shows a detail to a larger scale of the storage apparatus of FIG. 1.

As shown in the detail front views of FIG. 5, each bin 12 has a pair of side walls 48 comprising a part of respective partition members. Each of the side walls of inner ones of the bins is also the side wall of an immediately laterally adjacent bin. Each bin has upper and lower floor members 50, with the lower floor member of one bin forming an upper floor member of an underlying bin.

The horizontal partition members configured as the floor members 50 are dimensioned to enable them to be inserted into and slide along a corresponding one of the horizontal slots 46. As shown in FIG. 7 which shows a detail of FIG. 3 to a larger scale, edge tabs 52 integral with the floor members 50 are bent upwardly and, at a fully inserted position of the floor member, are received in, and clamped by, clips 56 formed from struck out portions of corresponding partition members 30. The engagement between the tabs 52 and the clips 56 ensures the floor members are retained accurately in their desired positions, fix the spacing of adjacent pairs of partition members 30, and establish overall rigidity of the structure. A ledge projecting upwardly from the rear of the floor member is present for effective implementation of the pick process.

Although as shown in FIGS. 4 and 5, vertically adjacent partition members 30 are shown as being vertically aligned, in another configuration, the partition members 30 can be position to be vertically misaligned by suitably choosing the vertical slots into which neighbouring partition members 30 are inserted. In addition, although as illustrated, the back panel 33 extends the full height and width of the rack, the panel can alternatively be a plurality of sub-panels joined to a back wall frame (not shown) or could in fact comprise a lattice of generally vertical and generally horizontal interconnected frame members.

In operation, the rack is used to store medicament packages (not shown) with a single package within a bin or with some or all of the bins containing a vertical stack and/or a horizontal row of packages which are, in use, selectively manipulated to obtain access to a desired package. In a typical application, the packages are pill boxes or pill bottles, but may also be bottles containing liquid medicament or may be different packages entirely. In the row embodiment, the number of packages in each row is limited only by the depth of the partition members 30 as measured from the front side 19. The depth of the partition members 30 and therefore of the rack is chosen is chosen to match the range in number and size of packages to be stored in the rack.

The partition members 30 and the floor members 50 are mounted so that the bins have a range of heights and widths in order to accommodate a corresponding variety of sizes of medicament package. Thus, a fundamental horizontal spacing of the vertical slots 32 is chosen so that the partition members 30 can be located to provide a range of bin widths corresponding to a selected multiple of the fundamental spacing. In the embodiment shown, the partition members 62 are separated by a distance 2L where L is the spacing between adjacent series of slots. Wider bins are present between, for example, partition members 64 which are separated by 3L, and the widest bins are present between, for example, partition members 66 which are separated by 4L. Similarly, a fundamental spacing of the slots 46 is chosen so that the floor members 50 can be positioned to provide a range of bin heights corresponding to a selected multiple of the fundamental vertical spacing of the horizontal slots 46. In the embodiment shown, adjacent floor members 68 are separated by a distance 2H, where H is the fundamental spacing between adjacent slots 46. Taller bins are present between floor members 72 which are separated by 3H. Both the fundamental horizontal spacing of slots 32 and the fundamental vertical spacing of slots 46 can be made as small as practicably permitted by the structural integrity of the system and/or as required by the range of package sizes to be accommodated. The arrangement permits the selection of a large range of possible bin widths and heights, the range being limited at the lower end to the fundamental slot spacing and at the upper end to the full height or width of the rack.

Figure 8:
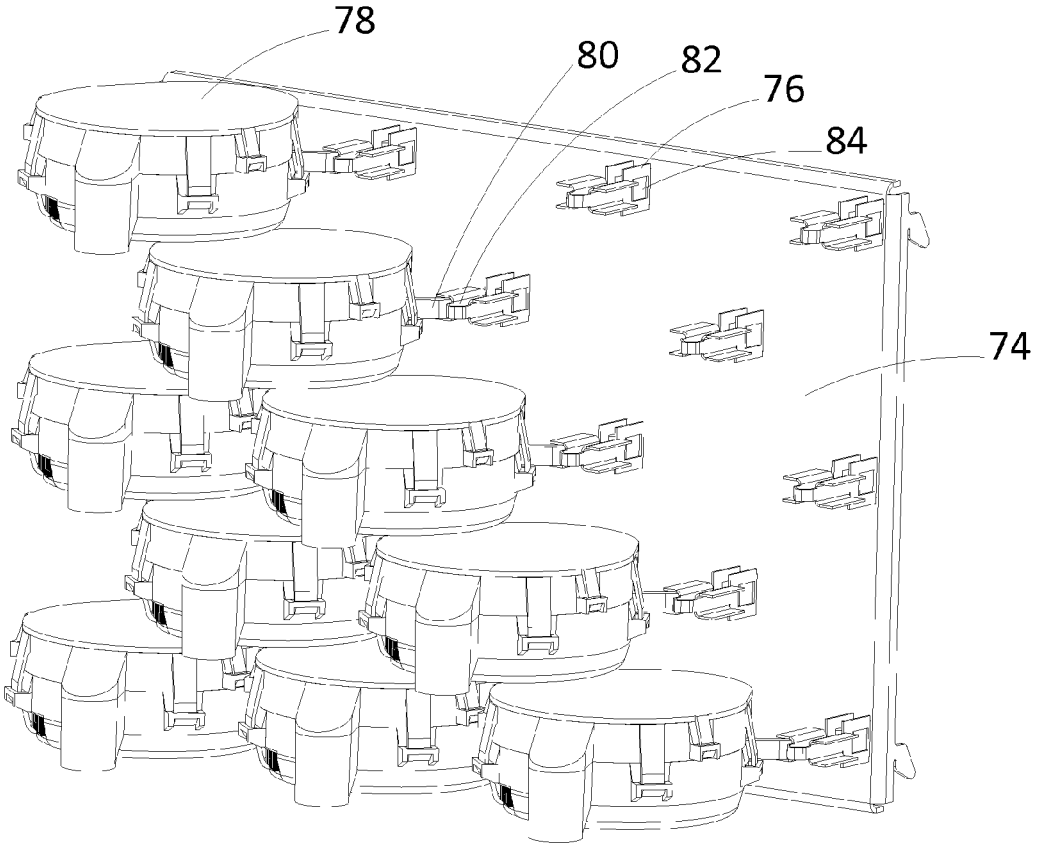
FIG. 8 is a perspective view of a sub-panel mountable on a rack system according to one embodiment of the invention.
Figure 9:
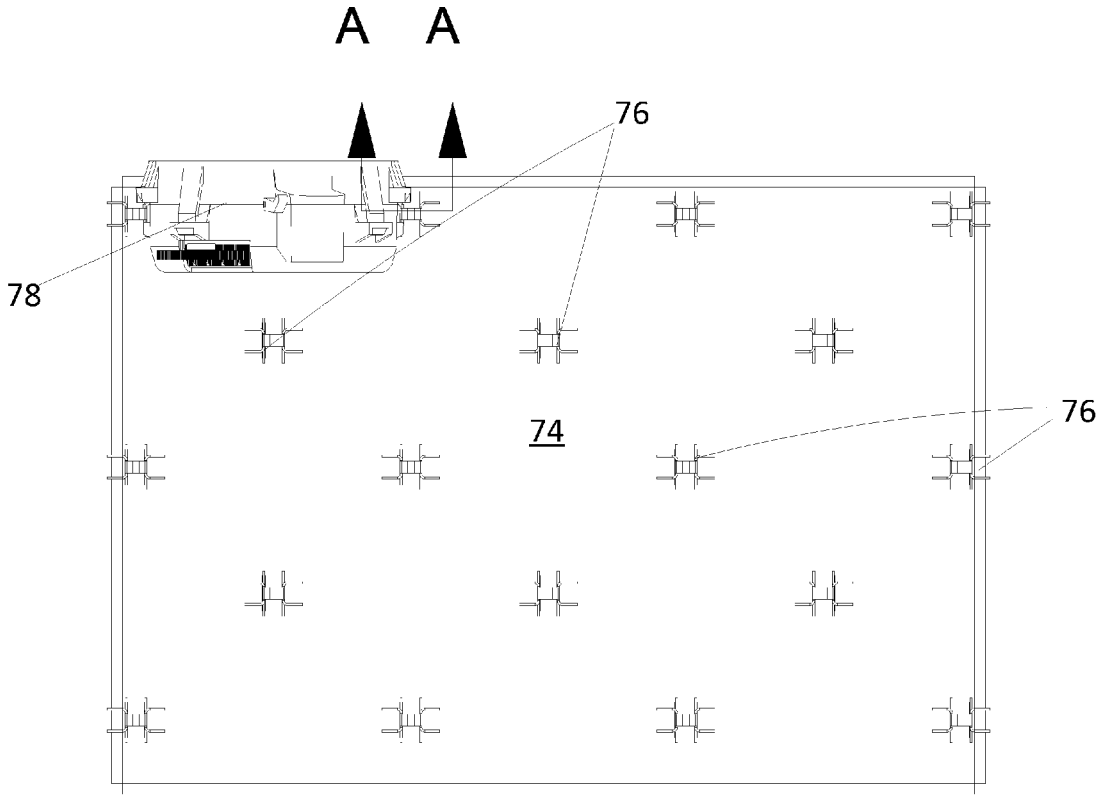
FIG. 9 is a front view of the sub-panel of FIG. 8 showing a function module mounted to the sub-panel.
Figure 10:
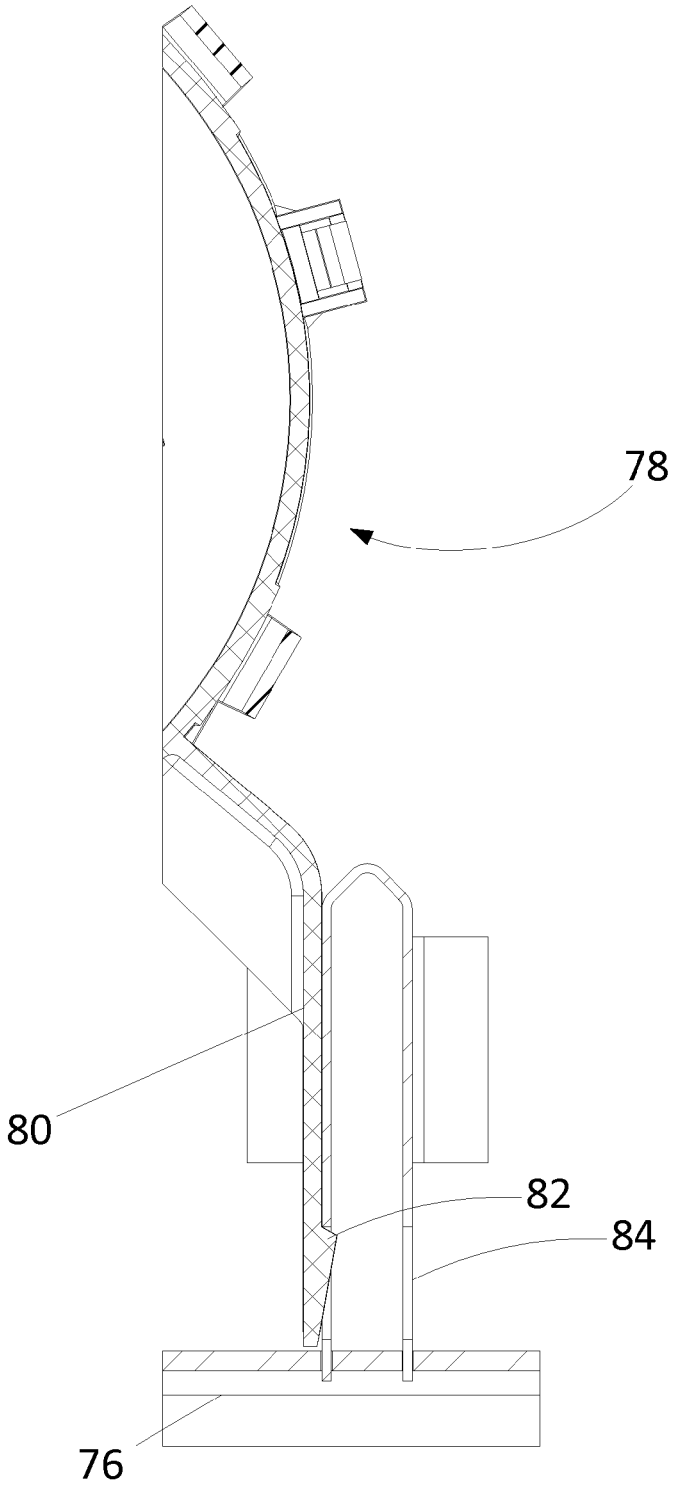
FIG. 10 is a sectional view on the line A-A showing a pill count module mounted on a sub-panel according to an embodiment of the invention.

Also mounted against the back wall by tongues 38 inserted into corresponding slots 32 in the back panel 33 is a sub-panel 74 which, as shown in FIGS. 8 and 9, has an array of pairs of brackets 76 extending from its front face. Demountably mounted at each pair of brackets is a pill counter module 78. As shown in FIG. 10, the module 78 has a pair of arms 80, of which one arm is shown, the arms formed so as to permit a predetermined range of spring flexure. At the end of each arm is a projection 82 which cooperates with a corresponding detent 84 on a respective bracket to enable the pill counter module 78 to be clipped to and suspended in an operational position from the sub-panel 74. In contrast with the storage bins 12, the pill counter is one of a number of function modules that can be mounted on a sub-panel. The pill counter 78 is in fact a combination pill hopper, singulator and dispenser whereby a required number of pills can be delivered for picking and dispensing by a pick head. Another form of function module (not shown) has bulk material storage element and is used to reconstitute, mix, and/or cause a reaction between, bulk materials for subsequent pick of a prepared medicament from the module. A further form of function module (not shown) comprises a dilution unit to dilute a medicament concentrate with water or other diluent at the time of medicament dispensing. In use, the pick head described above with respect to the picking and loading of medicament packages has an additional actuating means to actuate the function to be performed at each of the installed function modules. It will be understood that the size of the function zone can be tailored to the particular type and number of functions to be performed by selecting one or more sub-panel from a range of sizes and mounting the required number and types of function modules to the or each sub-panel.

In an alternative embodiment of the invention (not shown), some or all of the function modules are formed with tongues similar to the tongues 38 on the partition members, with the function modules being mounted directly to the back panel 33 by insertion of the tongues 38 into slots 32. Some or all of the storage bins and/or function modules may be located in a zone of the bin rack which is at room temperature, while others may be located in a controlled temperature section such as a refrigerated zone for proper storage of medicaments that are prone to deterioration at room temperature.

Although in the preferred embodiments described herein, the bins are located in a rack as an array of rows and columns, other arrays are possible such as a radial array or a diagonal array. In such arrays, the rectangular form of bin may not be optimal and alternative bin shapes may be of advantage. In such alternative embodiments, the floor member of a bin may not extend horizontally or may not extend horizontally over its full extent. In a radial array, the back panel is formed with slots or other fixture means that extend radially from a central location while in a diagonal array, the slots or other fixture means in the back wall extend diagonally.

In addition, although as shown in the illustrated embodiments of the invention, slots and cooperating tongues/edge portions are used to fix the partition members to the back wall and to fix the floor members to the partition members, alternative fixture means can be used. For example, the back wall and the partition members can be formed with respective cooperating I and U rails. In use the U rails are slid onto or place over the I rails and locked into place. Similarly, the partition members and the floor members can be formed with cooperating I and U rails.

In all of the illustrated embodiments, the vertically extending partition members are attached to the back panel and the horizontally extending floor members are attached to the partition members. In an alternative embodiment of the invention (not shown), horizontally extending partition members are attached to the back panel and the vertically extending partition members are attached to the horizontally extending partition members. Such an arrangement has the disadvantage of requiring a sturdier mounting arrangement between the horizontally extending partition members and the back panel, but has the advantage that, if desired, side walls of the bins, as configured by the vertically extending partition members, can be dispensed with altogether to make more lateral space available for storage. In such an arrangement, the pick head is used to precisely load and pick a particular package on a floor member at an accurately chosen lateral position.

Other variations and modifications will be apparent to those skilled in the art. The embodiments of the invention described and illustrated are not intended to be limiting. The principles of the invention contemplate many alternatives having advantages and properties evident in the exemplary embodiments.

What is claimed is:

1. A rack assembly comprising:

a support;

first and second pluralities of partition members:

the partition members of one of the pluralities of partition members demountably mounted to the support, the partition members of said one plurality of partition members extending generally vertically; and the partition members of the other plurality of partition members demountably mounted to respective ones of the partition members of the one plurality of partition members, the partition members of the other plurality of partition members extending generally horizontally;

first mounting fixtures on the support, the first mounting fixtures positioned as a plurality of vertically extending series, each series of first mounting fixtures horizontally spaced from an adjacent series of first mounting fixtures by a predetermined distance L;

second mounting fixtures on the partition members of said one plurality of partition members;

respective pairings of the first and second mounting fixtures interengageable to demountably mount the partition members of said one plurality of partition members to the support;

third mounting fixtures on the partition members of the one plurality of partition members;

fourth mounting fixtures on the partition members of the other plurality of partition members;

respective pairings of the third and fourth mounting fixtures interengageable to demountably mount partition members of said other plurality of partition members to partition members of said one plurality of partition members; and a plurality of bins, each bin having opposed side walls and opposed upper and lower floor members, the side walls each comprising at least a part of respective partition members of said one plurality of partition members, the floor members each comprising a respective partition member of said other plurality of partition members, each bin having side walls in common with immediately laterally adjacent bins and floor members in common with immediately vertically adjacent bins.

2. A rack assembly as claimed in claim 1, wherein the support is a back panel, each first mounting fixture comprising a generally vertically extending slot in the back panel.

3. A rack assembly as claimed in claim 2, wherein each second mounting fixture comprises a tongue for insertion into a corresponding one of the slots.

4. A rack assembly as claimed in claim 3, wherein the weight of each partition member of said one plurality of partition members acts to retain such partition member in the corresponding slot.

5. A rack assembly as claimed in claim 4, wherein each floor member has a width n×L where n is an integer between 1 and N and where N×L is the width of the rack.

6. A rack assembly as claimed in claim 1, the rack assembly further comprising a function zone, the function zone having a vertical and horizontal extent, the support over the extent of the function zone having no partition members mounted thereat, and at least one function module mounted to the support at the function zone.

7. A rack assembly as claims in claim 6, the function module indirectly mounted to the support, the rack assembly further comprising a sub-panel having fifth mounting fixtures enabling demountable mounting of the sub-panel at corresponding ones of the first mounting fixtures of the support, the function module demountably mounted to the sub-panel.

8. A rack assembly as claimed in claim 6, the function module directly mounted to the support at one or more of the first mounting fixtures.

9. A rack assembly as claimed in claim 6, the function module being one of a pill counting unit, a pill singulating unit, a pill dispensing unit, a bulk material mixing unit, a bulk material reconstituting unit, a bulk materials mixing unit, a bulk materials reacting unit, and a bulk material diluting unit.

10. A rack assembly comprising:

a support;

first and second pluralities of partition members:

the partition members of one of the pluralities of partition members demountably mounted to the support, the partition members of said one plurality of partition members extending generally vertically; and the partition members of the other plurality of partition members demountably mounted to respective ones of the partition members of the one plurality of partition members, the partition members of the other plurality of partition members extending generally horizontally;

first mounting fixtures on the support;

second mounting fixtures on the partition members of said one plurality of partition members;

respective pairings of the first and second mounting fixtures interengageable to demountably mount the partition members of said one plurality of partition members to the support;

third mounting fixtures on the partition members of the one plurality of partition members;

fourth mounting fixtures on the partition members of the other plurality of partition members, each fourth mounting fixture vertically spaced from an adjacent fourth mounting fixture by a distance H;

respective pairings of the third and fourth mounting fixtures interengageable to demountably mount partition members of said other plurality of partition members to partition members of said one plurality of partition members; and a plurality of bins, each bin having opposed side walls and opposed upper and lower floor members, the side walls each comprising at least a part of respective partition members of said one plurality of partition members, the floor members each comprising a respective partition member of said other plurality of partition members, each bin having side walls in common with immediately laterally adjacent bins and floor members in common with immediately vertically adjacent bins.

11. A rack assembly as claimed in claim 10, each bin floor member separated from a next vertically adjacent bin floor member by a height m×H, where m is an integer between 1 and M and M×H is the height of the rack.

12. A rack assembly as claimed in claim 10, wherein the fourth mounting fixture comprises a generally horizontally extending slot.

13. A rack assembly as claimed in claim 12, each partition member of said one plurality of partition members formed from a pair of parallel plates, respective plates having spaced, non-contact regions within which the generally horizontally extending slots are formed and contacting regions at which the plates are fixed to one another.

14. A rack assembly as claimed in claim 13, wherein each of the floor members and the partition members of said one plurality of partition members are respectively formed with corresponding interengagable first and second locking formations to permit locking of the floor members to corresponding ones of the partition members of said one plurality of partition members.

15. A rack assembly as claimed in claim 12, wherein each third mounting fixture is an edge part of the corresponding floor member for insertion into a corresponding one of the generally horizontally extending slots.

16. A rack assembly comprising:

a support;

first and second pluralities of partition members:

the partition members of one of the pluralities of partition members demountably mounted to the support, the partition members of said one plurality of partition members extending generally vertically; and the partition members of the other plurality of partition members demountably mounted to respective ones of the partition members of the one plurality of partition members, the partition members of the other plurality of partition members extending generally horizontally;

first mounting fixtures on the support;

second mounting fixtures on the partition members of said one plurality of partition members;

respective pairings of the first and second mounting fixtures interengageable to demountably mount the partition members of said one plurality of partition members to the support;

third mounting fixtures on the partition members of the one plurality of partition members;

fourth mounting fixtures on the partition members of the other plurality of partition members, each fourth mounting fixture vertically spaced from an adjacent fourth mounting fixture by a distance H;

respective pairings of the third and fourth mounting fixtures interengageable to demountably mount partition members of said other plurality of partition members to partition members of said one plurality of partition members;

a plurality of bins, each bin having opposed side walls and opposed upper and lower floor members, the side walls each comprising at least a part of respective partition members of said one plurality of partition members, the floor members each comprising a respective partition member of said other plurality of partition members, each bin having side walls in common with immediately laterally adjacent bins and floor members in common with immediately vertically adjacent bins; and a function zone having a vertical and horizontal extent, the support over the extent of the function zone having no partition members mounted thereat, and at least one function module mounted to the support at the function zone.

17. A rack assembly as claims in claim 16, the function module indirectly mounted to the support, the rack assembly further comprising a sub-panel having fifth mounting fixtures enabling demountable mounting of the sub-panel at corresponding ones of the first mounting fixtures of the support, the function module demountably mounted to the sub-panel.

18. A rack assembly as claimed in claim 16, the function module directly mounted to the support at one or more of the first mounting fixtures.

19. A rack assembly as claimed in claim 16, the function module being one of a pill counting unit, a pill singulating unit, a pill dispensing unit, a bulk material mixing unit, a bulk material reconstituting unit, a bulk materials mixing unit, a bulk materials reacting unit, and a bulk material diluting unit.

* * * * *